US006157126A

United States Patent [19]

Yano et al.

[11] Patent Number: 6,157,126

[45] Date of Patent: Dec. 5, 2000

[54] WARM WHITE FLUORESCENT LAMP

[75] Inventors: Tadashi Yano, Soraku-gun; Kenjiro Hashimoto, Osaka; Makoto Inohara, Katano, all of Japan

[73] Assignee: Matsushita Electric Industrial Co., Ltd., Osaka, Japan

[21] Appl. No.: 09/041,544

[22] Filed: Mar. 11, 1998

[30] Foreign Application Priority Data

Mar. 13, 1997 [JP] Japan ..... 9-058925

[51] Int. Cl.[7] ..... H01J 1/62; H01J 63/04

[52] U.S. Cl. ..... 313/485; 313/486; 313/487

[58] Field of Search ..... 313/485, 486, 313/487, 488, 483; 252/301.4 R

[56] References Cited

U.S. PATENT DOCUMENTS

| | | | |
|---|---|---|---|
| 4,029,983 | 6/1977 | Thorton . | |
| 4,065,688 | 12/1977 | Thorton . | |
| 4,263,530 | 4/1981 | Van Broekhoven et al. . | |
| 4,296,353 | 10/1981 | Walter . | |
| 4,305,019 | 12/1981 | Graff et al. . | |
| 4,357,559 | 11/1982 | Piper . | |
| 5,193,900 | 3/1993 | Yano et al. . | |
| 5,418,419 | 5/1995 | McGuire . | |
| 5,539,276 | 7/1996 | Excell et al. . | |
| 5,612,590 | 3/1997 | Trushell et al. | 313/487 |
| 5,714,836 | 2/1998 | Hunt et al. | 313/487 |
| 5,838,101 | 11/1998 | Pappalardo | 313/487 |

FOREIGN PATENT DOCUMENTS

| | | | |
|---|---|---|---|
| 0 100 122 | 2/1984 | European Pat. Off. . | |
| 0 209 942 | 1/1987 | European Pat. Off. . | |
| 0239923 | 10/1987 | European Pat. Off. . | |
| 04189021 | 3/1991 | European Pat. Off. . | |
| 0 529 098 | 3/1993 | European Pat. Off. . | |
| 0596548A1 | 5/1994 | European Pat. Off. | 313/487 |
| 25 09 563 | 9/1974 | Germany . | |
| 57128778 | 8/1982 | Japan . | |
| 01186748 | 7/1989 | Japan . | |
| 01186749 | 7/1989 | Japan . | |
| 05086364 | 4/1993 | Japan | 313/487 |
| 06036746 | 2/1994 | Japan . | |
| 06044947 | 2/1994 | Japan | 313/487 |
| 07258631 | 3/1994 | Japan . | |
| 6-180248 | 6/1994 | Japan . | |
| 07105912 | 4/1995 | Japan . | |
| 7-94146 | 4/1995 | Japan . | |
| 07258632 | 10/1995 | Japan . | |
| 2529477 | 6/1996 | Japan . | |
| 9-120797 | 5/1997 | Japan . | |
| 2142775 | 1/1985 | United Kingdom . | |

OTHER PUBLICATIONS

European Search for Int'l. Appln. No. 98104481.1 dated Dec. 28, 1998.

JIS Z 8726–1990; "Method of Specifying Color Rendering Properties of Light Sources".

CIE Pub. 13.2 (TC–3.2) 1974; "Method of Measuring and Specifying Color Rendering Properties of Light Sources".

Austrian Search Report for Singapore application No. 9800527–5, dated Oct. 22, 1999.

K. Hashimoto et al. "Visual Clarity and Feeling of Contrast", *Color Research and Application*, vol. 19, No. 3, pp. 171–185 (Jun. 1994).

K. hashimoto et al. "New Method for Specifying Color Rendering Properties of Light Source Based on the Feeling of Contrast", *J. Illuminating Engineering Institute of Japan*, vol. 79, No. 11 pp. 29–37 (1995).

Y. Nayatani et al., "Lightness Dependency of Chroma Scales of a Nonlinear Color–Appearance Model and its Latest Formulation", *Color Research and Application*, vol. 20, No. 3, pp. 156–167 (Jun. 1995).

*Primary Examiner*—Ashok Patel
*Assistant Examiner*—Michael J. Smith
*Attorney, Agent, or Firm*—Ratner & Prestia

[57] ABSTRACT

A warm white fluorescent lamp wherein the visual clarity index of said lamp is in a range from 121 to 145 inclusive, the correlated color temperature of its light color is in a range from 2700 K to 3150 K inclusive, and the chromaticity point of said light color is located within a chromaticity range where distance of chromaticity point from the Planckian locus on the CIE 1960 uv chromaticity diagram is not less than −0.005 and not greater than +0.005.

16 Claims, 6 Drawing Sheets

WARM WHITE FLUORESCENT LAMP

BACKGROUND OF THE INVENTION

1. Field of the Invention

The present invention relates to a warm white fluorescent lamp which produces light in the warm white region.

2. Description of the Related Art

Three band fluorescent lamps having high efficacy and high color rendering properties are widely used as general lighting lamps. The three band fluorescent lamp is one that produces light predominantly in three wavelength regions where the human eye is most sensitive to color, that is, blue at about 450 nm, green at about 540 nm, and red at about 610 nm, and thus achieves increased color rendition without reducing luminous flux. Three band fluorescent lamps with different light colors are produced by varying the energies in the three wavelength regions.

For the past few years, three band fluorescent lamps designed to produce light that simulates the incandescent lamp color to create a warm and relaxed atmosphere (hereinafter called three band warm white fluorescent lamps) have been drawing much attention and have been finding application for indoor lighting. The warm white resembles the light color of an incandescent lamp, and since the three band warm white fluorescent lamp is superior in efficacy to the incandescent lamp, this type of fluorescent lamp has the potential of replacing the incandescent lamp.

Though the light colors are similar, the three band warm white fluorescent lamp is inferior in color rendition to the incandescent lamp in the following respect.

The incandescent lamp has the color characteristic that not only enhances a warm and relaxed atmosphere but has the effect of brining out the beauty of colored objects and creating a high-quality atmosphere.

The three band warm white fluorescent lamp, on the other hand, is inferior to the incandescent lamp in terms of object color appearance, especially the appearance of red and reddish object colors. The previous three band warm white fluorescent lamp thus has had the problem that its color rendition is clearly inferior to that of the incandescent lamp when it comes to the high-quality atmosphere associated with the color appearance that the incandescent lamp can provide. As a piece of information, the appearance of green and greenish object colors is comparable to or better than that of the incandescent lamp.

In view of the inferior appearance of red and reddish object colors associated with the previous three band warm white fluorescent lamp, it is an object of the present invention to provide a three band warm white fluorescent lamp that achieves red and reddish color appearance comparable to or better than that of the incandescent lamp and green and greenish color appearance comparable to or better than that of the incandescent lamp, and yet has higher efficacy than that of the incandescent lamp.

Regarding color appearance under illuminating light, a method known as the "method of evaluating the fidelity of color appearance" is used to quantitatively evaluate the color rendering properties of a light source. This method, specified in JIS Z 8726-1990 "Method of Specifying Color Rendering Properties of Light Sources", is intended to quantitatively evaluate how faithfully the lamp under test is rendering the target color in comparison with the color rendered under a reference illuminant. JIS Z 8726-1990" "Method of Specifying Color Rendering Properties of Light Sources" is essentially regulated in accordance with the method set forth in the CIE Pub.13.2 "Method of Measuring and Specifying Color Rendering Properties of Light Sources(1974)". The value is expressed in terms of the General Color Rendering Index Ra. Nowadays, development of fluorescent lamps are directed toward increasing the General Color Rendering Index Ra and improving luminous efficacy.

On the other hand, besides the method of evaluating the fidelity of color appearance, work on a "method of evaluating the desirability of color appearance" has been proceeding in recent years. This method is intended to quantitatively evaluate whether the color shift caused by the light source under test, as compared with the color observed under the reference illuminant, is in the desirable direction or undesirable direction. This evaluation method shows that if there is a color shift when evaluated in terms of the fidelity described above, if it is a shift in the desirable direction it will bring a better result in terms of color appearance when seen by humans.

Regarding the method of evaluating the desirability of color appearance, by noting the visual clarity (visual clarity effect) associated with the color rendering properties of a light source, it has been found that the degree of vividity of object color appearance can be evaluated using a visual clarity index developed from the concept of visual clarity, as described in such publications as "Hashimoto et al., Visual Clarity and Feeling of Contrast, Color Research and Application, 19, 3, June (1994)," "Hashimoto et al., Method of Evaluating the Color Rendering Properties of a Light Source Based on Visual Clarity, J. of the Illuminating Engineering Institute of Japan, Vol. 79, No. 11, 1995," and "Japanese Patent Unexamined Publication NO. 6-180248 (Japanese Patent Application No. 4-333919).

Accordingly, in developing a warm white fluorescent lamp that can produce the same beautiful, high-quality atmosphere as obtained from the object color appearance of the incandescent lamp, if the color appearance of objects important for the visual clarity effect of the light source, i.e., the red of food and the green of tree leaves, can be made comparable to or better than the color appearance of the incandescent lamp by using the method of evaluating the desirability of color appearance, then it will become possible to create a high-quality atmosphere by effectively eliciting the beauty only of the object colors that are important for the enhancement of the high-quality effect.

Stated another way, the most important issue is to determine the color characteristic range within which the color appearance of objects important for the visual clarity effect of the light source, i.e., the red of food and the green of tree leaves, is substantially comparable to or better than the color appearance of such objects under the incandescent lamp by using the method of evaluating the desirability of color appearance.

SUMMARY OF THE INVENTION

The present invention provides a fluorescent lamp that has high lamp efficacy and, based on a visual clarity index M, provides a color characteristic substantially comparable to that of the incandescent lamp.

A warm white fluorescent lamp of the present invention is that the visual clarity index of said lamp is in a range from 121 to 145 inclusive, the correlated color temperature of its light color is in a range from 2700 K to 3150 K inclusive, and the chromaticity point of said light color is located within a chromaticity range where distance of chromaticity point from the Planckian locus on the CIE 1960 uv chromaticity diagram is not less than −0.005 and not greater than +0.005.

A warm white fluorescent lamp of the present invention is that the visual clarity index of said lamp is in a range from 123 to 145 inclusive, the correlated color temperature of its light color is in a range from 2700 K to 2900 K inclusive, and the chromaticity point of said light color is located within a chromaticity range where distance chromaticity point from the Planckian locus on the CIE 1960 uv chromaticity diagram is not less than −0.005 and not greater than +0.005.

A warm white fluorescent lamp of the present invention is that the correlated color temperature of its light color is in a range from 2700 K to 3150 K inclusive, the chromaticity point of said light color is located within a chromaticity range where distance of chromaticity point from the Planckian locus on the CIE 1960 uv chromaticity diagram is not less than −0.005 and not greater than +0.005, and the visual clarity index of said lamp satisfies $M \geqq 75000/T+97.0$ and $M \leqq 75000/T+118.5$ A warm white fluorescent lamp according to the present invention is that said lamp is constructed using a blue phosphor whose peak wevelength is located within a range from 400 nm to 460 nm inclusive, a green phosphor whose peak wevelength is located within a range from 500 nm to 550 nm inclusive, a red phosphor whose peak wevelength is located within a range from 600 nm to 620 nm inclusive, and a deep red phosphor whose peak wevelength is located within a range from 625 nm to 670 nm inclusive.

A warm white fluorescent lamp according to the present invention is that said blue phosphor is a blue phosphor activated with bivalent europium whose peak wavelength is located within a range from 400 nm to 460 nm inclusive, said green phosphor is a green phosphor activated with terbium whose peak wavelength is located within a range from 500 nm to 550 nm inclusive, said red phosphor is a red phosphor activated with trivalent europium whose peak wavelength is located within a range from 600 nm to 620 nm inclusive, and said deep red phosphor is a deep red phosphor activated with manganese whose peak wavelength is located within a range from 625 nm to 670 nm inclusive.

A warm white fluorescent lamp according to the present invention is that in said warm white fluorescent lamp, said blue phosphor is in an range from 0% to 6% inclusive, said green phosphor is in a range from 20% to 25% inclusive, said red phosphor is in a range from 30% to 55% inclusive, and said deep red phosphor is in a range from 20% to 55% inclusive, by weight.

A warm white fluorescent lamp according to the present invention is that in said warm white fluorescent lamp, said blue phosphor is in an range from 0% to 6% inclusive, said green phosphor is in a range from 20% to 25% inclusive, said red phosphor is in a range from 30% to 50% inclusive, and said deep red phosphor is in a range from 25% to 50% inclusive, by weight.

A warm white fluorescent lamp according to the present invention is that said blue phosphor is a blue phosphor activated with bivalent europium whose peak wavelength is located within a range from 400 nm to 460 nm inclusive, said green phosphor is a green phosphor activated with terbium or terbium cerium whose peak wavelength is located within a range from 500 nm to 550 nm inclusive, said red phosphor is a red phosphor activated with trivalent europium whose peak wavelength is located within a range from 600 nm to 620 nm inclusive, and said deep red phosphor is a deep red phosphor activated with cerium manganese whose peak wavelength is located within a range from 625 nm to 670 nm inclusive.

A warm white fluorescent lamp according to the present invention is that said lamp is constructed primarily with a blue phosphor activated with bivalent europium, a green phosphor activated with terbium or terbium cerium, and a deep red phosphor activated with cerium manganese.

DESCRIPTION OF THE PREFERRED EMBODIMENTS

Figure 1:
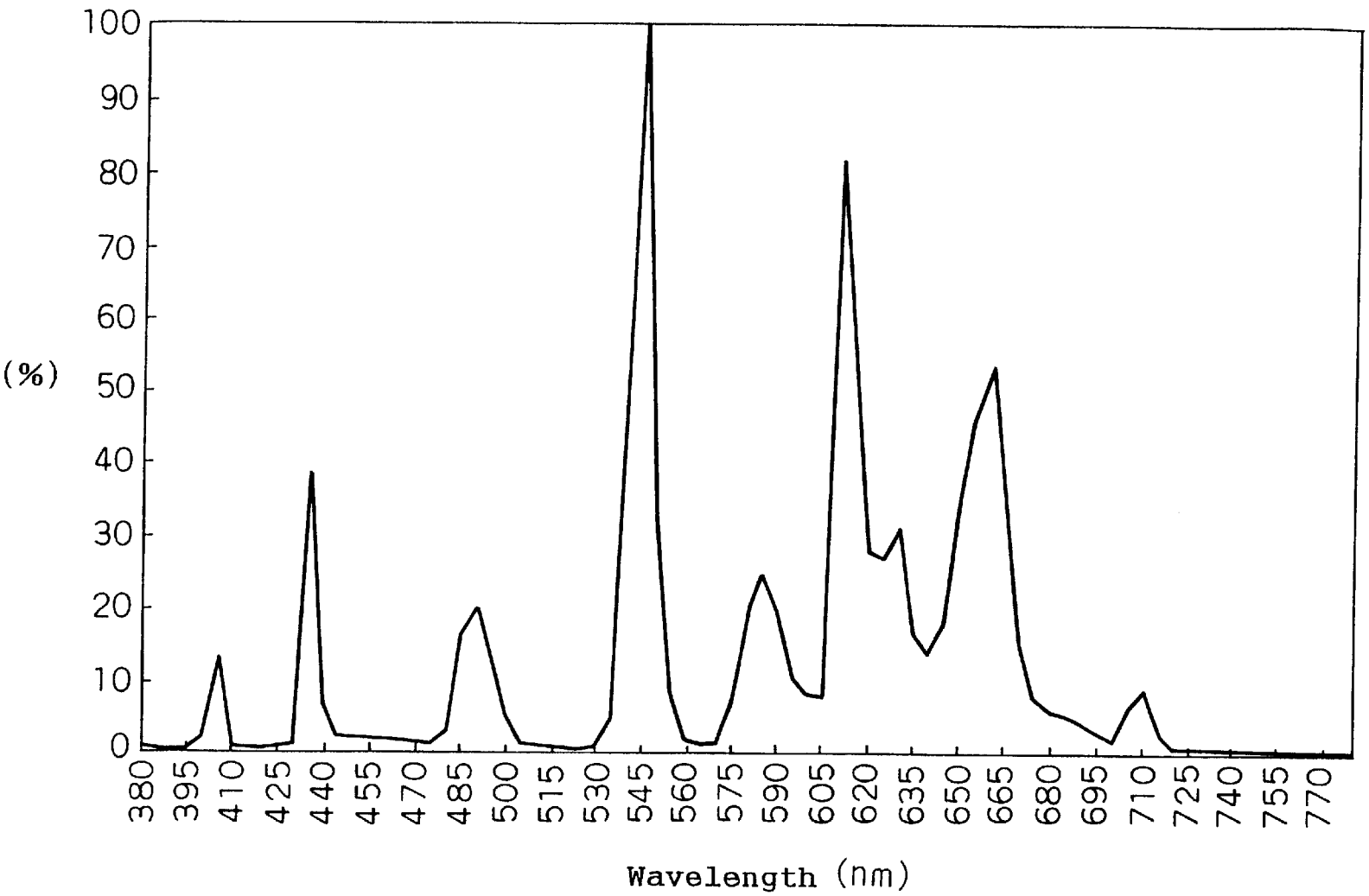
FIG. 1 is a diagram showing the relative spectrum distribution of a warm white fluorescent lamp according to one embodiment of the present invention.

First, visual clarity index M will be described briefly. The degree of visual clarity of a colored object illuminated by a lighting lamp is expressed by the color area size of four test colors (red, yellow, green, and blue). The color area size of the four test colors is calculated based on a color system defining brightness (B) and colorfulness (Mr-g, My-b) in a nonlinear color appearance model proposed by Nayatani et al. (e.g., Nayatani et al., Color Research and Application, 20, 3, (1995)). Table 1 shows the spectral radiance factors of the four test colors.

<Spectral Radiance Factors of Four Test Colors for Visual Clarity Evaluation>

TABLE 1

| ① | ② | ③ | ④ | ⑤ |
|---|---|---|---|---|
| 380 | 0.058 | 0.078 | 0.075 | 0.066 |
| 385 | 0.059 | 0.084 | 0.081 | 0.070 |
| 390 | 0.061 | 0.092 | 0.088 | 0.076 |
| 395 | 0.061 | 0.099 | 0.096 | 0.085 |
| 400 | 0.061 | 0.103 | 0.101 | 0.092 |
| 405 | 0.061 | 0.106 | 0.105 | 0.101 |
| 410 | 0.060 | 0.107 | 0.108 | 0.109 |
| 415 | 0.060 | 0.107 | 0.110 | 0.110 |
| 420 | 0.059 | 0.107 | 0.112 | 0.111 |
| 425 | 0.059 | 0.108 | 0.115 | 0.120 |
| 430 | 0.058 | 0.109 | 0.118 | 0.123 |
| 435 | 0.058 | 0.110 | 0.122 | 0.135 |
| 440 | 0.058 | 0.111 | 0.125 | 0.154 |
| 445 | 0.057 | 0.113 | 0.130 | 0.172 |
| 450 | 0.056 | 0.115 | 0.135 | 0.184 |
| 455 | 0.055 | 0.116 | 0.141 | 0.192 |
| 460 | 0.055 | 0.118 | 0.149 | 0.200 |
| 465 | 0.054 | 0.120 | 0.158 | 0.208 |
| 470 | 0.053 | 0.123 | 0.166 | 0.211 |
| 475 | 0.052 | 0.126 | 0.175 | 0.209 |
| 480 | 0.051 | 0.130 | 0.184 | 0.202 |
| 485 | 0.050 | 0.137 | 0.195 | 0.190 |
| 490 | 0.050 | 0.148 | 0.209 | 0.177 |
| 495 | 0.049 | 0.164 | 0.227 | 0.163 |
| 500 | 0.049 | 0.194 | 0.256 | 0.147 |
| 505 | 0.049 | 0.240 | 0.291 | 0.132 |
| 510 | 0.049 | 0.298 | 0.325 | 0.118 |
| 515 | 0.050 | 0.376 | 0.352 | 0.105 |

TABLE 1-continued

| ① | ② | ③ | ④ | ⑤ |
|---|---|---|---|---|
| 520 | 0.050 | 0.451 | 0.363 | 0.094 |
| 525 | 0.051 | 0.529 | 0.361 | 0.084 |
| 530 | 0.051 | 0.596 | 0.348 | 0.077 |
| 535 | 0.052 | 0.645 | 0.331 | 0.071 |
| 540 | 0.053 | 0.684 | 0.308 | 0.067 |
| 545 | 0.054 | 0.710 | 0.284 | 0.063 |
| 550 | 0.055 | 0.726 | 0.260 | 0.061 |
| 555 | 0.057 | 0.737 | 0.235 | 0.058 |
| 560 | 0.060 | 0.743 | 0.213 | 0.057 |
| 565 | 0.062 | 0.747 | 0.191 | 0.055 |
| 570 | 0.065 | 0.750 | 0.171 | 0.054 |
| 575 | 0.068 | 0.750 | 0.154 | 0.053 |
| 580 | 0.075 | 0.749 | 0.137 | 0.053 |
| 585 | 0.089 | 0.749 | 0.121 | 0.052 |
| 590 | 0.116 | 0.746 | 0.108 | 0.052 |
| 595 | 0.150 | 0.743 | 0.096 | 0.052 |
| 600 | 0.198 | 0.738 | 0.087 | 0.052 |
| 605 | 0.263 | 0.734 | 0.080 | 0.051 |
| 610 | 0.338 | 0.729 | 0.075 | 0.052 |
| 615 | 0.412 | 0.726 | 0.072 | 0.052 |
| 620 | 0.489 | 0.723 | 0.071 | 0.052 |
| 625 | 0.555 | 0.721 | 0.070 | 0.052 |
| 630 | 0.603 | 0.720 | 0.069 | 0.052 |
| 635 | 0.641 | 0.719 | 0.069 | 0.052 |
| 640 | 0.665 | 0.718 | 0.069 | 0.052 |
| 645 | 0.682 | 0.718 | 0.069 | 0.052 |
| 650 | 0.694 | 0.717 | 0.069 | 0.052 |
| 655 | 0.703 | 0.718 | 0.069 | 0.052 |
| 660 | 0.708 | 0.719 | 0.070 | 0.052 |
| 665 | 0.713 | 0.721 | 0.072 | 0.051 |
| 670 | 0.716 | 0.723 | 0.073 | 0.051 |
| 675 | 0.718 | 0.725 | 0.074 | 0.051 |
| 680 | 0.720 | 0.727 | 0.076 | 0.051 |
| 685 | 0.722 | 0.729 | 0.077 | 0.051 |
| 690 | 0.724 | 0.730 | 0.079 | 0.051 |
| 695 | 0.726 | 0.732 | 0.080 | 0.051 |
| 700 | 0.731 | 0.734 | 0.081 | 0.052 |
| 705 | 0.733 | 0.734 | 0.081 | 0.053 |
| 710 | 0.738 | 0.735 | 0.081 | 0.054 |
| 715 | 0.742 | 0.735 | 0.080 | 0.056 |
| 720 | 0.746 | 0.734 | 0.080 | 0.058 |
| 725 | 0.751 | 0.734 | 0.080 | 0.060 |
| 730 | 0.754 | 0.736 | 0.081 | 0.062 |
| 735 | 0.756 | 0.736 | 0.083 | 0.064 |
| 740 | 0.758 | 0.740 | 0.086 | 0.067 |
| 745 | 0.760 | 0.742 | 0.090 | 0.071 |
| 750 | 0.763 | 0.744 | 0.094 | 0.077 |
| 755 | 0.765 | 0.747 | 0.098 | 0.089 |
| 760 | 0.766 | 0.747 | 0.102 | 0.106 |
| 765 | 0.769 | 0.749 | 0.105 | 0.129 |
| 770 | 0.770 | 0.750 | 0.108 | 0.155 |
| 755 | 0.773 | 0.750 | 0.110 | 0.176 |
| 780 | 0.774 | 0.749 | 0.112 | 0.193 |

① Wavelength (nm)
② Red
③ Yellow
④ Green
⑤ Blue

Figure 2:
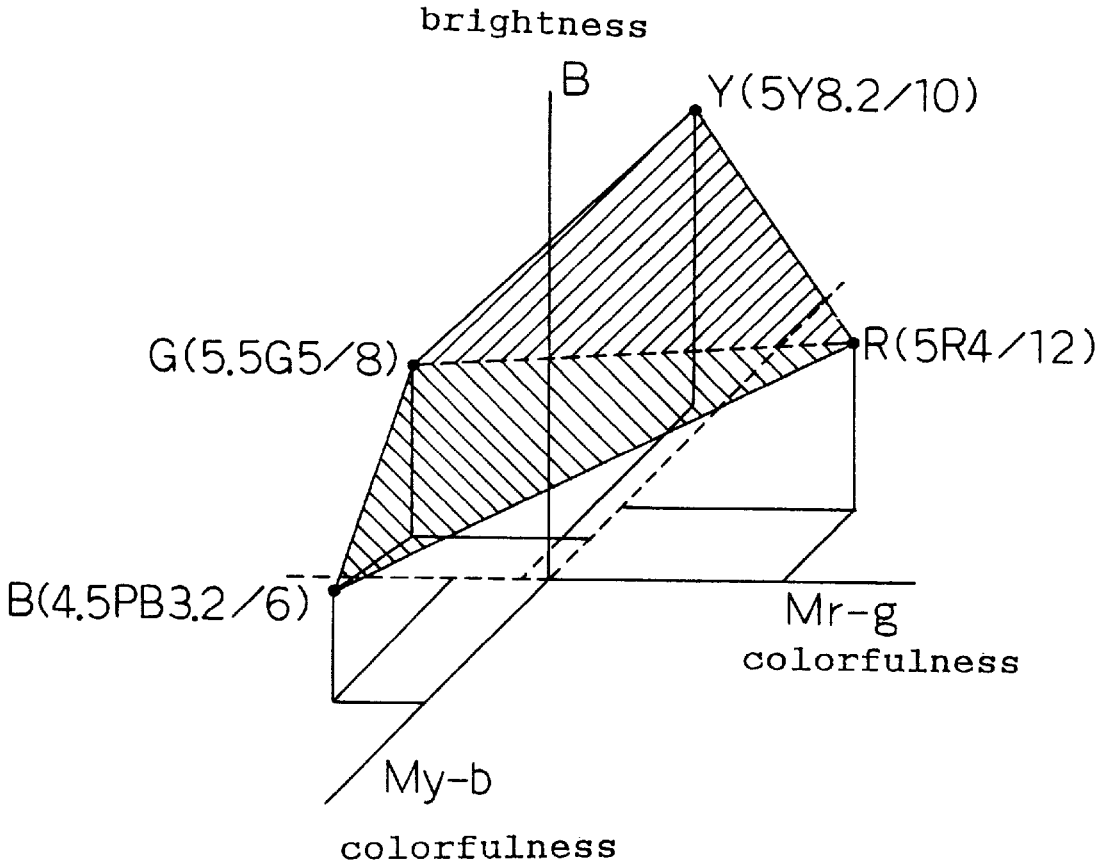
FIG. 2 is a diagram showing a visual clarity index M that provides the basic concept of the present invention.

As shown in FIG. 2, since the test color that most contributes to visual clarity is red, the red test color is taken as the reference and the sum of the area of the triangle enclosed by the red, blue, and green test colors and the area of the triangle enclosed by the red, yellow, and green test colors is defined as the color area of the four test colors (red, yellow, green, and blue). Using the color area of the four test colors, the visual clarity index M is expressed by equation 1.

$$M=[G(S, 1000\ (lx)/G(D65, 1000\ (lx))]^{1.6}\times 100 \qquad \text{[Equation 1]}$$

where G(S, 1000 (lx)) indicates the color area of the four test colors under a test light source S at illuminance 1000 (lx), and G(D65, 1000 (lx)) represents the color area of the four test colors under a reference light source D65 at reference illuminance 1000 (lx).

Here, the visual clarity index M of the lamp is specified as 100 when the color area of the four test colors under the illumination of an arbitrary lighting lamp is substantially equal to the color area thereof under the standard illuminant D65, that is, when the visual clarity equivalent to that under the standard illuminant D65 is obtained. The higher the visual clarity index M, the greater the lamp's effect of enhancing the visual clarity of object colors such as the red of flowers and the green of tree leaves.

In the present invention, the most important issue is, as previously described, to determine the range of visual clarity indices within which the color appearance of objects important for the visual clarity effect of the light source, i.e., the red and green of food, flower, and tree leaves, is substantially comparable to or better than the color appearance of such objects under the incandescent lamp.

We conducted an evaluation experiment to determine the range of visual clarity indices that provide effects substantially equivalent to the color appearance of the incandescent lamp by producing several different 40 W straight-tube warm white fluorescent lamps with different visual clarity indices M.

Each of the warm white fluorescent lamps used in the experiment was produced by mixing three color phosphors, i.e., a green phosphor $LaPO_4$: $Ce^{3+}$, $Tb^{3+}$ (designated LAP in Table 2), a blue phosphor $Sr_{10}(PO_4)_6Cl_2$: $Eu^{2+}$ (designated SCA in Table 2), and red phosphors $Y_2O_3$: $Eu^{3+}$ (designated YOX in Table 2) and $3.5MgO{\cdot}0.5MgF_2{\cdot}GeO_2$: $Mn^{4+}$ (designated MFG in Table 2). Further, a warm white fluorescent lamp having a correlated color temperature of 2800 K equivalent to the color temperature of the incandescent lamp to be compared was also produced for comparison purposes.

In the observation experiment, each fluorescent lamp and the incandescent lamp were installed on the ceiling of an observation booth which measured 170 cm deep, 150 cm wide, and 180 cm high.

The Munsell values of the wall surface of the observation booth, the floor surface, and the desk were N8.5,N5,N7 respectively. On the desk were placed foods such as a tomato, lemon, orange, and green pepper, various colorful flowers and plants such as a crimson rose, red, pink, and white carnations, a small yellow chrysanthemum, a statice with bluish purple and reddish purple flowers, and a white bellflower with purple and pink edges, and other items such as a glass, plaster work, hand mirror, small tatami mat, newspaper, and magazine, plus 15 kinds of color chips. The experiment was conducted under the fluorescent lamp lighting and incandescent lamp lighting alternately, and the appearance of the colors in the observation booth was evaluated by comparing the color appearance under the fluorescent lamp with the color appearance under the incandescent lamp as time elapsed.

Evaluation of each fluorescent lamp as a replacement for an incandescent lamp was performed by judging whether the object colors were rendered almost as beautiful and vivid as when they were rendered under the incandescent lamp, and whether the object colors were not rendered too vivid as compared with the object colors rendered under the incandescent lamp. The lamp samples used in the evaluation experiment and the results of their evaluations are shown in Table 2.

TABLE 2

| No. | SCA | LAP | YOX | MFG | ② | Δuv | ③ | ④ |
|---|---|---|---|---|---|---|---|---|
| 1 | 1.6 | 20.8 | 0 | 77.6 | 2965 | −2.4 | 201 | X |
| 2 | 0.8 | 21 | 23.5 | 54.7 | 2783 | 1.7 | 160 | X |
| 3 | 1.2 | 21.7 | 30.8 | 46.4 | 2780 | 1.4 | 150 | X |
| 4 | 1.5 | 22.5 | 38 | 38 | 2780 | 0.4 | 142 | ○ |
| 5 | 1.5 | 23.7 | 44.9 | 29.9 | 2809 | 1.2 | 135 | ○ |
| 6 | 1.5 | 24.5 | 51.8 | 22.3 | 2800 | 1.9 | 128 | ○ |
| 7 | 1.5 | 25.3 | 58.6 | 14.6 | 2773 | 1.4 | 123 | ○ |
| 8 | 3.9 | 25.1 | 71 | 0 | 2820 | −1.1 | 112 | X |
| ① | | | | | 2850 | 0 | 124 | |

① Incandescent Lamp
② Correlated Color Temperature
③ Visual Clarity Index
④ Result of Evaluation Table 2 shows the lamp sample number (No.), kinds of phosphors (SCA, LAP, YOX, andMFG) andtheirratios in weight percent, correlated color temperature, the distance of the chromaticity point from the Planckian locus (Δu,v, which is positive when the distance is in the upper left side of the Planckian locus, and negative when it is in the lower right side of the Planckian locus), visual clarity index M, and result of observation evaluation, in this order. The circle in Table 2 indicates the result of the evaluation showing that the object colors were rendered almost as beautiful and vivid as when rendered under the incandescent lamp and were not rendered too vivid as compared with the object colors rendered under the incandescent lamp.

As can be seen from Table 2, it was found that the lamp had a color characteristic equivalent to the color appearance of the incandescent lamp when the value of the visual clarity index M is smaller than 150 but not smaller than 124, a value approximately equal to the visual clarity index M of the incandescent lamp.

Figure 3:
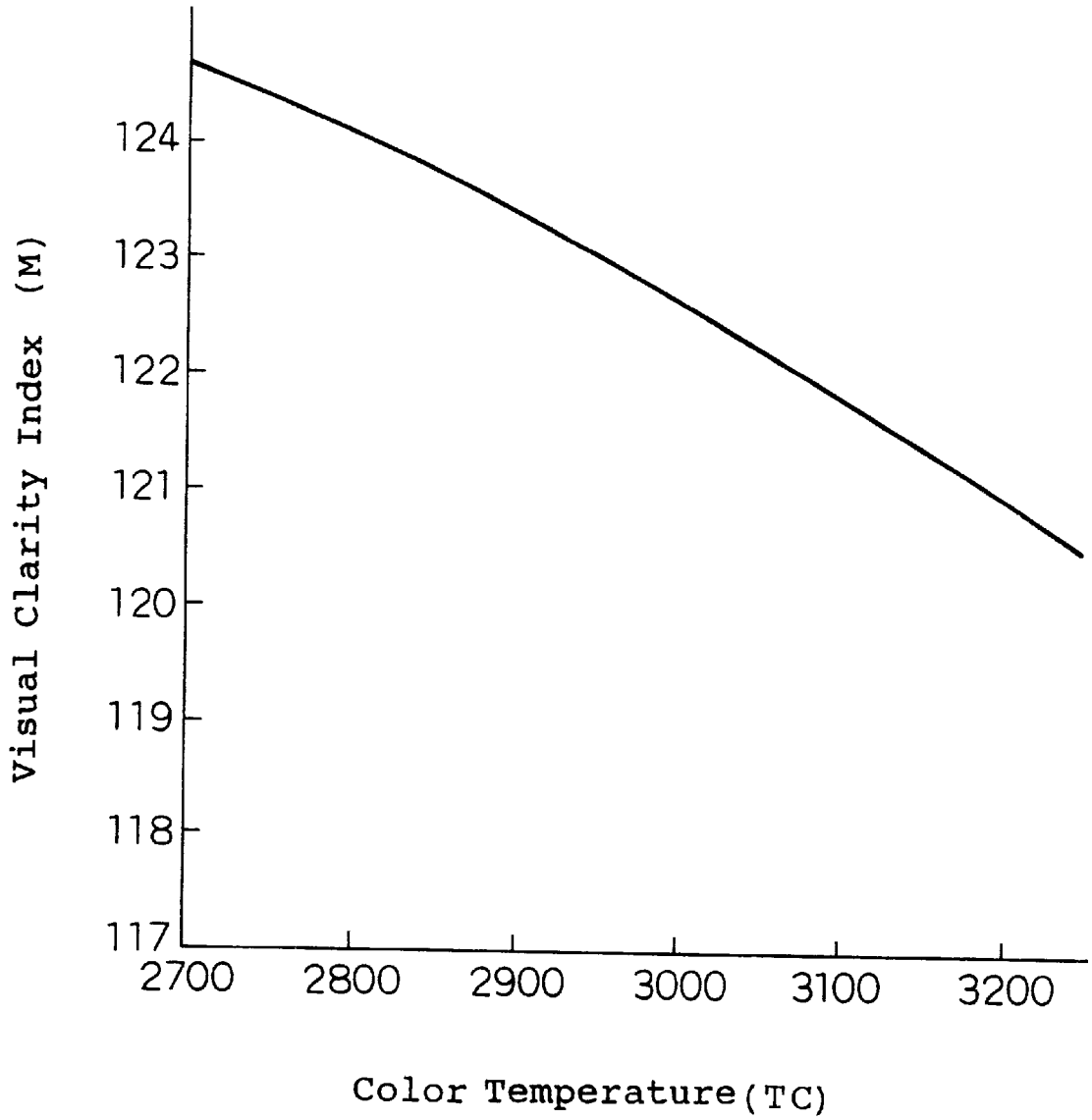
FIG. 3 is a diagram showing the visual clarity index M of an incandescent lamp.

Next, the relationship between the color temperature (TC) and visual clarity index (M) of an incandescent lamp is shown in FIG. 3. As can be seen from FIG. 3, the visual clarity index M of an incandescent lamp operating at 3150 K is 121. This means that a warm white fluorescent lamp with a correlated color temperature 3150 K needs to have a visual clarity index M of 121 or larger in order to achieve color appearance comparable to or better than that of the incandescent lamp at 3150 K. Likewise, the visual clarity index M of an incandescent lamp operating at 2900 K is 123. This means that a warm white fluorescent lamp with a correlated color temperature 2900 K needs to have a visual clarity index M of 123 or larger in order to achieve color appearance comparable to or better than that of the incandescent lamp at 2900 K.

The relationship between the correlated color temperature T and visual clarity index M of the lamp color can be expressed numerically by the following simultaneous inequalities.

$$M \geqq 75000/T+97.0$$

$$M \leqq 75000/T+118.5$$

Here, the correlated color temperature of the lamp light color is in a range from 2700 K to 3150 K inclusive, and the chromaticity point of its light color is located within a chromaticity range where the distance of chromaticity point from the Planckian locus on the CIE 1960 uv chromaticity diagram is not less than −0.005 and not greater than +0.005.

Next, the relative spectral distribution of a warm white fluorescent lamp produced in accordance with one embodiment of the present invention will be shown below.

(First embodiment of the fluorescent lamp)

First, an example of the fluorescent lamp will be shown, dealing with a 40 W straight-tube fluorescent lamp constructed using four kinds of phosphors and having a correlated color temperature of 3000 K.

Figure 4:
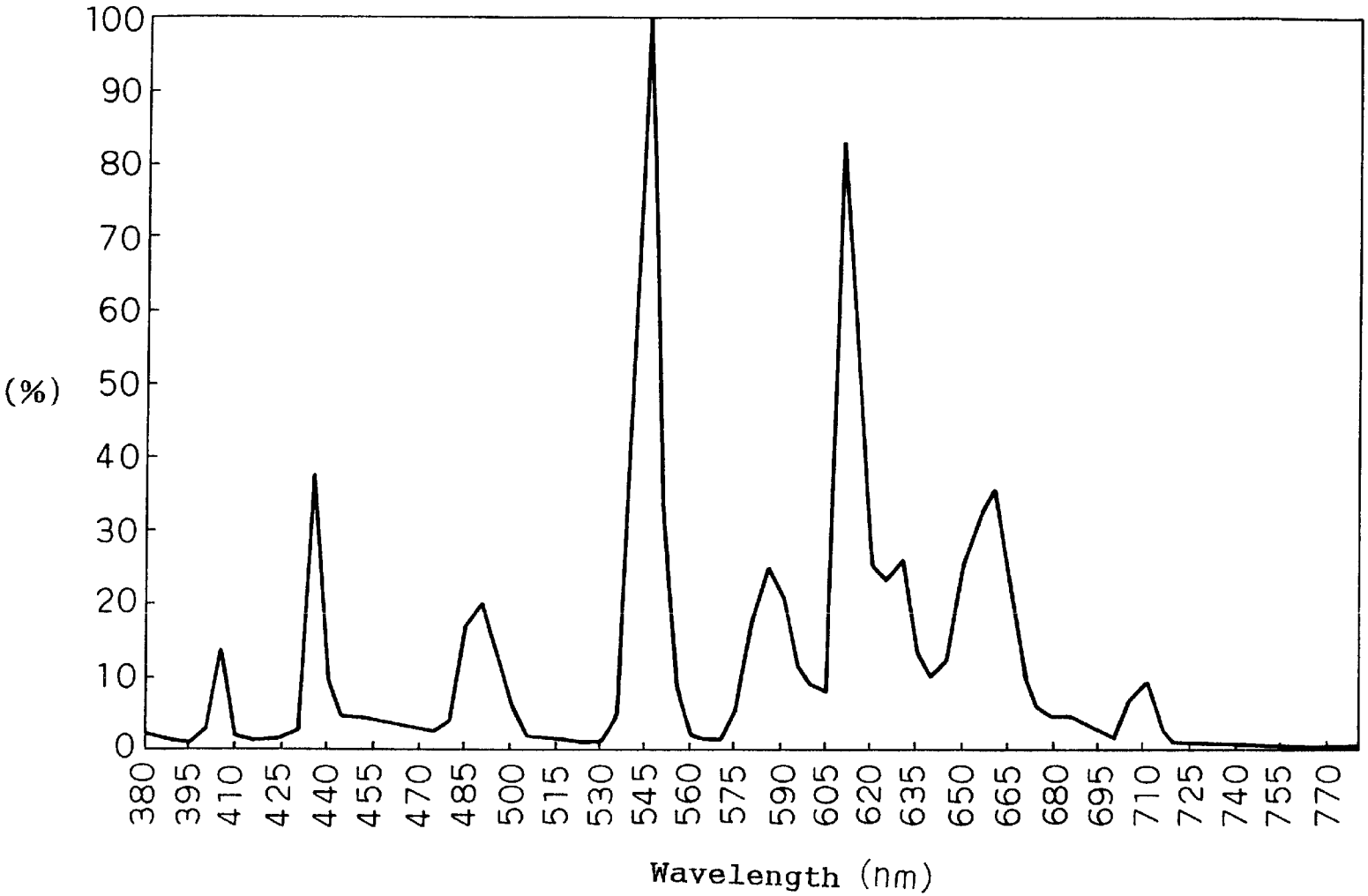
FIG. 4 is a diagram showing the relative spectrum distribution of a warm white fluorescent lamp according to one embodiment of the present invention.

FIG. 4 shows the spectral distribution of the fluorescent lamp constructed by mixing the four phosphors, $Sr_{10}(PO_4)_6Cl_2$: $Eu^{2+}$, $LaPO_4$: $Ce^{3+}$, $Tb^{3+}$, $Y_2O_3$: $Eu^{3+}$, and $3.5MgO \cdot 0.5MgF_2 \cdot GeO_2$: $Mn^{4+}$, in proportions of about 2:21:46:31 by weight percent in this order. The visual clarity index M of the fluorescent lamp of FIG. 4 is 133, and its lamp efficacy is about 72 lm/W. The distance of chromaticity point is −0.0003 from the Planckian locus on the CIE 1960 uv chromaticity diagram.

The visual clarity index M of an incandescent lamp at 3000 K is 122, and its lamp efficacy is about 12 lm/W.

Therefore, the fluorescent lamp of FIG. 4 has a lamp efficacy about six times as high as that of the incandescent lamp, and a visual clarity index M higher than that of the incandescent lamp. This means that the warm white fluorescent lamp shown here can render colors, especially the red of flowers and the green of tree leaves, more beautiful and vivid than when the same colors are rendered under the incandescent lamp.

(Second embodiment of the fluorescent lamp)

A second embodiment of the present invention will be described next. Usually, incandescent lamps operate at around 2800 K. The fluorescent lamp of FIG. 4 has a correlated color temperature of 3000 K and, therefore, it s light looks somewhat whiter than incandescent lam p light of 2800 K. A correlated color temperature from 2700 K to 2900 K centered around 2800 K is thus considered optimum as a replacement for ordinary incandescent lamp light.

One example of a fluorescent lamp constructed using four kinds of phosphors and having a correlated color temperature of 2800 K is shown below.

FIG. 1 shows the spectral distribution of the fluorescent lamp constructed by mixing the four phosphors, $Sr_{10}(PO_4)_6Cl_2$: $Eu^{2+}$, $LaPO_4$: $Ce^{3+}$, $Tb^{3+}$, $Y_2O_3$: $Eu^{3+}$, and $3.5MgO \cdot 0.5MgF_2 \cdot GeO_2$: $Mn^{4+}$, in proportions of about 2:22:38:38 by weight percent in this order.

This fluorescent lamp corresponds to the fluorescent lamp No. 4 in Table 2.

The visual clarity index M of the fluorescent lamp of FIG. 1 is 144, and its lamp efficacy is about 66 lm/W. The distance of chromaticity point of its light color is 0.0004 from the Planckian locus on the CIE 1960 uv chromaticity diagram. On the other hand, the visual clarity index M of an incandescent lamp operating at 2800 K is 124, and its lamp efficacy is about 12 lm/W.

Therefore, the fluorescent lamp of FIG. 1 has a lamp efficacy about 5.5 times as high as that of the incandescent lamp, and a visual clarity index M higher than that of the incandescent lamp. This means that the warm white fluorescent lamp shown here can render colors, especially the red of flowers and the green of tree leaves, more beautiful and vivid than when the same colors are rendered under the incandescent lamp.

(Third embodiment of the fluorescent lamp)

Figure 6:
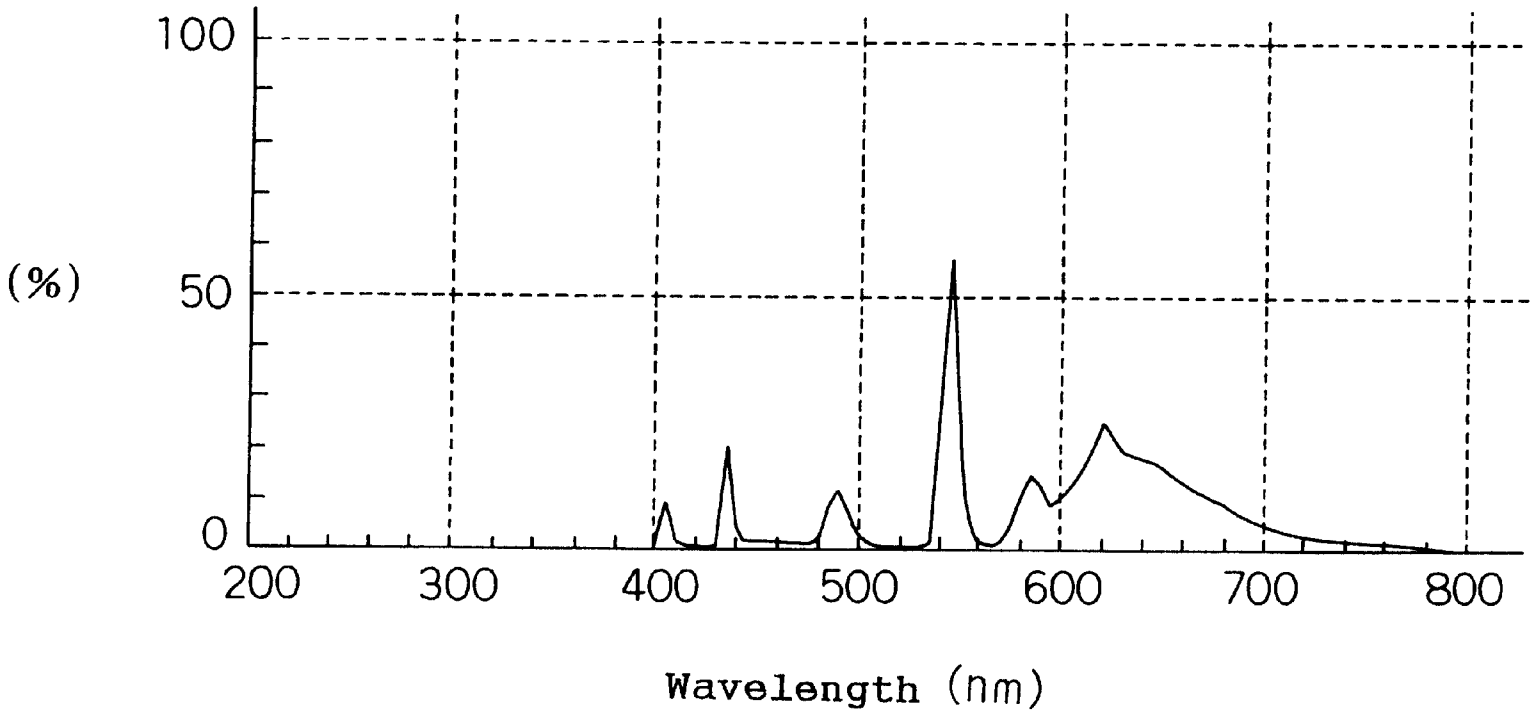
FIG. 6 is a diagram showing the relative spectrum distribution of a warm white fluorescent lamp according to one embodiment of the present invention.

A third embodiment of the present invention is shown in FIG. 6. This embodiment uses a deep red phosphor activated with cerium manganese as the deep red phosphor.

FIG. 6 shows the spectral distribution of a fluorescent lamp constructed by mixing three kinds of phosphors, $BaMgAl_{10}O_{17}$: $Eu^{2+}$, $LaPO_4$: $Ce^{3+}$, $Tb^{3+}$, and $GdMgB_5O_{10}$: $Ce^{3+}$,$Mn^{2+}$.

In FIG. 6, the visual clarity index M is 145, the color temperature is 2800 K, the distance of chromaticity point of light color is 0 from the Planckian locus on he CIE 1960 uv chromaticity diagram.

Thus the fluorescent lamp of FIG. 6 has a higher visual clarity index M than that of the incandescent lamp, which means that the warm white fluorescent lamp shown here can render colors, especially the red of flowers and the green of tree leaves, more beautiful and vivid than when the same colors are rendered under the incandescent lamp.

Though specific embodiments of the present invention have been shown in FIGS. 1, 4, and 6, it will be appreciated that the present invention can also be embodied by various other phosphor combinations. For example, phosphors producing light at 400 nm to 460 nm include $Sr_2P_2O_7$: $Eu^{2+}$, $Sr_{10}(PO_4)_6Cl_2$: $Eu^{2+}$, $(Sr,Ca)_{10}(PO_4)_6Cl_2$: $Eu^{2+}$, $(Sr,Ca)_{10}(PO_4)_6Cl_2 \cdot nB_2O_3$: $Eu^{2+}$, and $BaMg_2Al_{16}O_{27}$: $Eu^{2+}$; phosphors producing light at 500 nm to 550 nm include $LaPO_4$: $Ce^{3+}$, $Tb^{3+}$, $La_2O_3 \cdot 0.2SiO_2 \cdot 0.9P_2O_5$: $Ce^{3+}$,$Tb^{3+}$, $CeMgAl_{11}O_{19}$: $Tb^{3+}$, and $GdMgB_5O_{10}$: $Ce^{3+}$,$Tb^{3+}$; phosphors producing light at 600 nm to 620 nm include $Y_2O_3$: $Eu^{3+}$; and phosphors producing light at 625 nm to 670 nm include $Y_2O_3$: $Eu^{3+}$, $GdMgB_5O_{10}$: $Ce^{3+}$,$Tb^{3+}$,$Mn^{2+}$, $GdMgB_5O_{10}$: $Ce^{3+}$,$Mn^{2+}$, $Mg_6As_2O_{11}$: $Mn^{4+}$, and $3.5MgO \cdot 0.5MgF_2 \cdot GeO_2$: $Mn^{4+}$.

Further, it will be appreciated that a warm white fluorescent la1p having a color characteristic substantially equivalent to that of the incandescent lamp can also be produced if a phosphor having a peak emission at other wavelength is added in minute quantities, other than the blue phosphor having a peak emission at 400 m to 460 nm, the green phosphor at 500 nm to 550 nm, the red phosphor at 600 nm to 620 nm, and the deep red phosphor at 625 nm to 670 nm.

The above embodiments have each dealt with a warm white fluorescent lamp constructed with a 40 W straight tube, but it will be recognized that the fluorescent lamp of the present invention can be constructed at different lamp wattages and in different tube shapes.

As the distance $\Delta u,v$ of the chromaticity point of light color from the chromaticity point on the Planckian locus is brought closer to zero on the CIE 1960 uv chromaticity diagram, the fluorescent lamp light color becomes closer to the incandescent lamp color. In the case of fluorescent lamps, however, variations occur in light color in the manufacturing process, and the distance $\Delta u,v$ is kept within an acceptable range of plus or minus 0.005 relative to 0 in order to produce light color close to the incandescent lamp light color.

Figure 5:
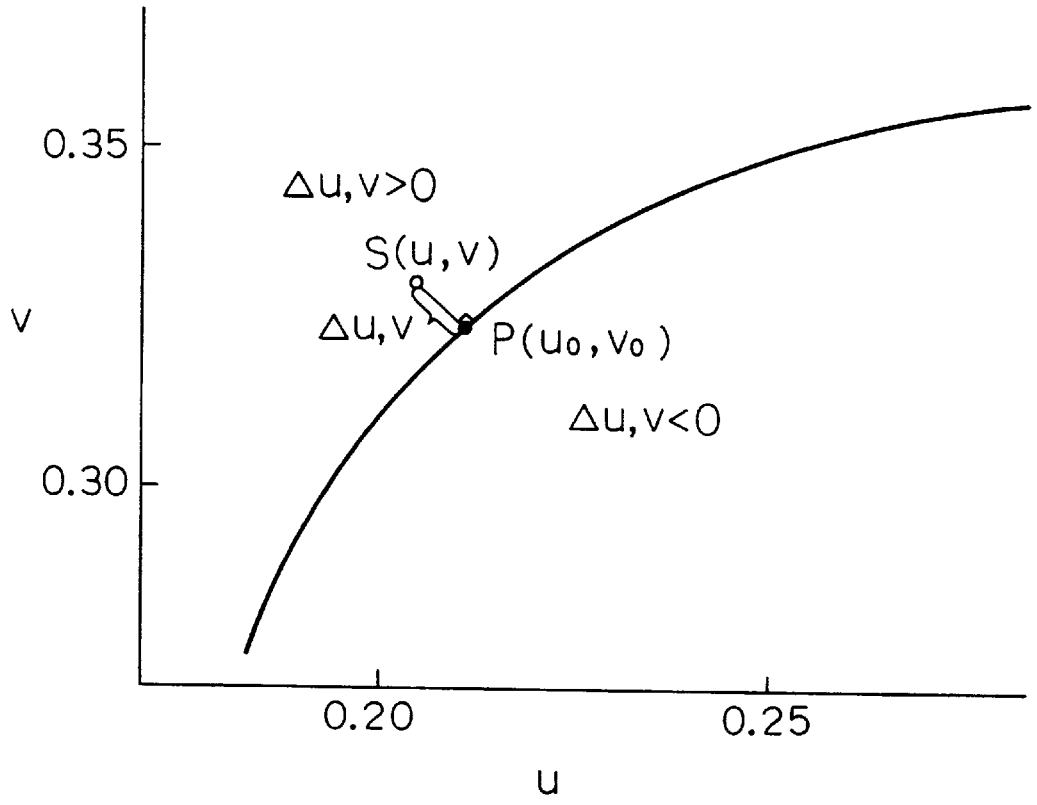
FIG. 5 is a diagram showing a chromaticity deviation SP.

Further, as show in FIG. 5, the chromaticity distance $\Delta u,v$ is d fined as distance SP between $S(u,v)$ and $P(u_0,v_0)$ on the CIE 1960 uv chromaticity diagram, where $S(u,v)$ is the chromaticity point of the light color of the light source and $P(u_0,v_0)$ is the point where a perpendicular dropped from the chromaticity point S to the Planckian locus intersects with the Planckian locus.

Here, the distance is positive ($\Delta u,v>0$) when it is located in the upper left side (in the greenish light color side) of the Planckian locus, and negative ($\Delta u,v<0$) when it is in the lower right side (in the reddish light color side).

As described above, according to the present invention, a warm white fluorescent lamp can be achieved that provides color appearance comparable to or better than the color appearance obtainable under the illumination with an incandescent lamp, and yet has high lamp efficacy compared with the incandescent lamp.

What is claimed is:

1. A warm white fluorescent lamp comprising at least three phosphors, wherein the visual clarity index of said lamp is a range from 121 to 145 inclusive, the correlated color temperature of its light color is in a range from 2700 K to 3150 K inclusive, and the chromaticity point of said light color is located within a chromaticity range where distance of chromaticity point from the Planckian locus on the CIE 1960 uv chromaticity diagram is not less than −0.005 and not greater than +0.005.

2. A warm white fluorescent lamp comprising at least three phosphors, wherein the visual clarity index of said lamp is a range from 123 to 145 inclusive, the correlated color temperature of its light color is in a range from 2700 K to 2900 K inclusive, and the chromaticity point of said light color is located within a chromaticity range where distance of chromaticity point from the Planckian locus on the CIE 1960 uv chromaticity diagram is not less than −0.005 and not greater than +0.005.

3. A warm white fluorescent lamp comprising at least three phosphors, wherein the correlated color temperature of its light color is in a range from 2700 K to 3150 K inclusive, the chromaticity point of said light color is located within a chromaticity range where distance of chromaticity point from the Planckian locus on the CIE 1960 uv chromaticity diagram is not less than −0.005 and not greater than +0.005, and the visual clarity index of said lamp satisfies:

$M \geqq 75000/T+97.0$, and $M \leqq 75000/T+118.5$.

4. A warm white fluorescent lamp according to claim 1, 2, or 3, wherein said at least three phosphors comprise a blue phosphor whose peak wavelength is located within a range of 400 nm to 460 nm inclusive, a green phosphor whose peak wavelength is located within a range from 500 nm to 550 nm inclusive, a red phosphor whose peak wavelength is located within the range 600 nm to 620 nm inclusive, and deep red phosphor whose peak wave length is located within a range from 625 nm to 670 nm inclusive.

5. A warm white fluorescent lamp according to claim 4, wherein said blue phosphor is a blue phosphor activated with bivalent europium whose peak wavelength is located within a range from 400 nm to 460 nm inclusive, sail green phosphor is a green phosphor activated with terbium whose peak wavelength is located within a range from 500 nm to 550 nm inclusive, said red phosphor is a red phosphor activated with trivalent europium whose peak wavelength is located within a range from 600 nm to 620 nm inclusive, and said deep red phosphor is a deep red phosphor activate d with manganese whose peak wavelength is located within a range from 625 nm to 670 nm inclusive.

6. A warm white fluorescent lamp according to claim 4, wherein said blue phosphor is a blue phosphor activated with bivalent europium, said green phosphor is a green phosphor activated with terbium or terbium cerium, said red phosphor is a red phosphor activated with trivalent europium, and said deep red phosphor is a deep red phosphor activated with cerium manganese.

7. A warm white fluorescent lamp according to claim 1, 2, or 3, wherein said at least three phosphors comprise a blue phosphor activated with bivalent europium, a green phosphor activated with terbium or terbium cerium, and a deep red phosphor activated with cerium manganese.

8. A warm white fluorescent lamp, wherein the visual clarity index of said lamp is a range from 121 to 145 inclusive, the correlated color temperature of its light color is in a range from 2700 K to 3150 K inclusive, and the chromaticity point of said light color is located within a chromaticity range where distance of chromaticity point from the Planckian locus on the CIE 1960 uv chromaticity diagram is not less than −0.005 and not greater than +0.005;

wherein:

said lamp comprises a blue phosphor whose peak wavelength is located within a range of 400 nm to 460 nm inclusive, a green phosphor whose peak wavelength is located within a range from 500 nm to 550 nm inclusive, a red phosphor whose peak wavelength is located within the range 600 nm to 620 nm inclusive, and deep red phosphor whose peak wavelength is located within a range from 625 nm to 670 nm inclusive; and said blue phosphor is in an range from 0% to 6% inclusive, said green phosphor is in a range from 20% to 25% inclusive, said red phosphor is in a range from 30% to 55% inclusive, and said deep red phosphor is in a range from 20% to 55% inclusive, by weight.

9. A warm white fluorescent lamp according to claim 8, wherein said blue phosphor is in a range from 0% to 6% inclusive, said green phosphor is in a range from 20% to 25% inclusive, said red phosphor is in a range from 30% to 50% inclusive, and said deep red phosphor is in a range from 25% to 50% inclusive, by weight.

10. A warm white fluorescent lamp, wherein the visual clarity index of said lamp is a range from 123 to 145 inclusive, the correlated color temperature of its light color is in a range from 2700 K to 2900 K inclusive, and the chromaticity point of said light color is located within a chromaticity range where distance of chromaticity point from the Planckian locus on the CIE 1960 uv chromaticity diagram is not less than −0.005 and not greater than +0.005;

wherein:

said lamp comprises a blue phosphor whose peak wavelength is located within a range of 400 nm to 460 nm inclusive, a green phosphor whose peak wavelength is located within a range from 500 nm to 550 nm inclusive, a red phosphor whose peak wavelength is located within the range 600 nm to 620 nm inclusive, and deep red phosphor whose peak wavelength is located within a range from 625 nm to 670 nm inclusive; and said blue phosphor is in an range from 0% to 6% inclusive, said green phosphor is in a range from 20% to 25% inclusive, said red phosphor is in a range from 30% to 55% inclusive, and said deep red phosphor is in a range from 20% to 55% inclusive, by weight.

11. A warm white fluorescent lamp according to claim 10, wherein said blue phosphor is in a range from 0% to 6% inclusive, said green phosphor is in a range from 20% to 25% inclusive, said red phosphor is in a range from 30% to 50% inclusive, and said deep red phosphor is in a range from 25% to 50% inclusive, by weight.

12. A warm white fluorescent lamp, wherein the correlated color temperature of its light color is in a range from 2700 K to 3150 K inclusive, the chromaticity point of said light color is located within a chromaticity range where distance of chromaticity point from the Planckian locus on the CIE 1960 uv chromaticity diagram is not less than −0.005 and not greater than +0.005, and the visual clarity index of said lamp satisfies $M \geqq 75000/T+97.0$ and $M \leqq 75000/T+118.5$;

wherein:

said lamp comprises a blue phosphor whose peak wavelength is located within a range of 400 nm to 460 nm inclusive, a green phosphor whose peak wavelength is located within a range from 500 nm to 550 nm inclusive, a red phosphor whose peak wavelength is located within the range 600 nm to 620 nm inclusive, and deep red phosphor whose peak wavelength is located within a range from 625 nm to 670 nm inclusive; and said blue phosphor is in a range from 0% to 6% inclusive, said green phosphor is in a range from 20% to 25% inclusive, said red phosphor is in a range from 30% to 55% inclusive, and said deep red phosphor is in a range from 20% to 55% inclusive, by weight.

13. A warm white fluorescent lamp according to claim 12, wherein said blue phosphor is in an range from 0% to 6% inclusive, said green phosphor is in a range from 20% to 25% inclusive, said red phosphor is in a range from 30% to 50% inclusive, and said deep red phosphor is in a range from 25% to 50% inclusive, by weight.

14. A warm white fluorescent lamp according to any one of claims 8–13, wherein the blue phosphor is $Sr_{10}(PO_4)_6Cl_2:Eu^{2+}$, the green phosphor is $LaPO_4:Ce^{3+}$, $Tb^{3+}$ the red phosphor is $Y_2O_3:Eu^{3+}$, and the deep red phosphor is $3.5MgO0.5MgF_2GeO_2:Mn^{4+}$.

15. A warm white fluorescent lamp of according to any one of claims 8–13, wherein the blue phosphor is selected from the group consisting of $Sr_2P_2O_7:Eu^{2+}$, $Sr_{10}(PO_4)_6Cl_2:Eu^{2+}$, $(Sr,Ca)_{10}(PO_4)_6Cl_2:Eu^{2+}$, $(Sr,Ca)_{10}(PO_4)_6Cl_2nB_2O_3Eu^{2+}$, and $BaMg_2Al_{16}O_{27}:Eu^{2+}$.

16. A warm white fluorescent lamp according to any of claims 8–13, wherein said blue phosphor is a bivalent europium activated blue phosphor, said green phosphor terbium activated green phosphor, said red phosphor trivalent europium activated red phosphor, and said deep red phosphor manganese activated deep red phosphor.

* * * * *

UNITED STATES PATENT AND TRADEMARK OFFICE

CERTIFICATE OF CORRECTION

PATENT NO. : 6,157,126
DATED : December 5, 2000
INVENTOR(S) : Yano et al.

It is certified that error appears in the above-identified patent and that said Letters Patent is hereby corrected as shown below:

Title page,
Item [56] References Cited, Foreign Patent Documents, "04189021 3/1991 European Pat. Off." should read -- 0 418 902 3/1991 European Pat. Off. --.

Item [56] References Cited, Other Publications, "K. hashimoto et al. "New Method for Specifying Color Rendering Properties of Light Source Based on the Feeling of Contrast", *J. Illuminating Engineering Institute of Japan*, vol. 79, No. 11, pp. 29-37 (1995)" should read -- K. Hashimoto et al. "New Method for Specifying Color Rendering Properties of Light Sources Based on the Feeling of Contrast", *J. Illuminating Engineering Institute of Japan*, vol. 79, No. 11, pp. 29-37 (1995) --.

Signed and Sealed this

Sixth Day of November, 2001

*Attest:*

Nicholas P. Godici

NICHOLAS P. GODICI
*Acting Director of the United States Patent and Trademark Office*

*Attesting Officer*